United States Patent [19]

Sadhukhan et al.

[11] 4,382,915

[45] May 10, 1983

[54] QUENCHING OF ZNO-CHAR GASIFICATION

[75] Inventors: Pasupati Sadhukhan, Katy, Tex.; William G. Billings, Bartlesville, Okla.

[73] Assignee: Phillips Petroleum Company, Bartlesville, Okla.

[21] Appl. No.: 310,718

[22] Filed: Oct. 13, 1981

[51] Int. Cl.[3] ..... C10J 3/46

[52] U.S. Cl. ..... 423/415 A; 48/197 R; 48/209; 48/210; 75/88

[58] Field of Search ..... 48/197 R, 210, 209; 423/415 A; 75/88, 14

[56] References Cited

U.S. PATENT DOCUMENTS

| | | | |
|---|---|---|---|
| 2,183,535 | 12/1939 | Betterton et al. | 75/88 |
| 2,263,751 | 11/1941 | Avery | 75/88 |
| 2,342,368 | 2/1944 | Queneau | 75/26 |
| 2,592,377 | 4/1952 | Barr et al. | 48/206 |
| 2,602,809 | 7/1952 | Dickinson | 48/206 |
| 2,668,760 | 2/1954 | Breyer et al. | 75/88 |
| 3,963,457 | 6/1976 | Hess | 48/202 |
| 3,975,188 | 8/1976 | Harvey et al. | 75/14 |
| 4,070,160 | 1/1978 | Cottle | 48/197 R |
| 4,112,058 | 9/1978 | Hanson | 48/197 R |

OTHER PUBLICATIONS

15 *Encyclopedia of Chemical Technology* (1965) pp. 250–251.

22 *Encyclopedia of Chemical Technology* 2nd Edition (1970) p. 579.

*Rogers' Industrial Chemistry* 6th Edition, vol. 2 (1942) pp. 940–941.

*Primary Examiner*—Peter F. Kratz

[57] ABSTRACT

In the gasification of char with zinc oxide improvement comprises the process of quenching the reactor effluent with recycled, cold CO product gas, thereby reducing the tendency for zinc vapor to react with any $CO_2$ present to form blue powder.

6 Claims, 1 Drawing Figure

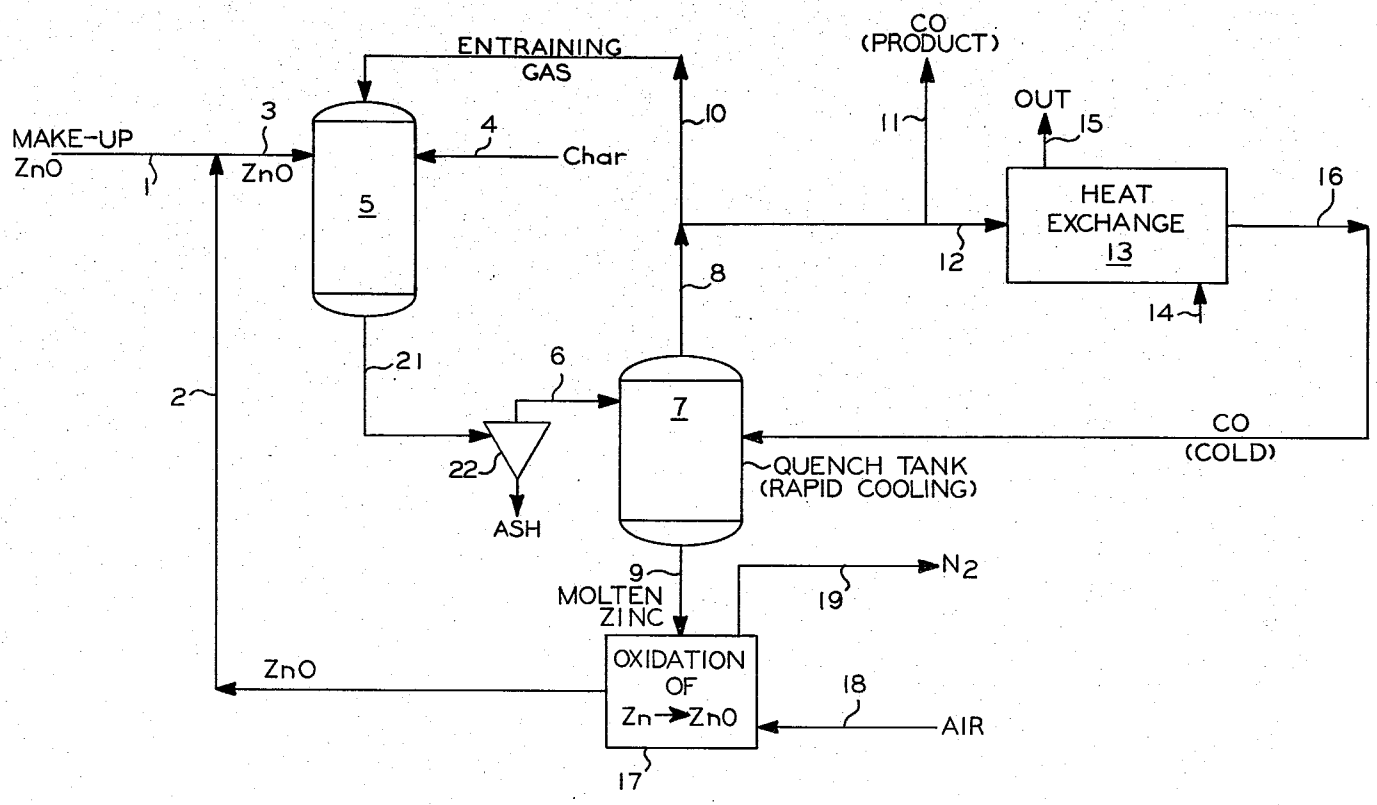
MAKE-UP ZnO
1
3
ZnO
5
ENTRAINING GAS
4
Char
10
CO (PRODUCT)
11
12
8
OUT
15
HEAT EXCHANGE 13
14
16
CO (COLD)
7
QUENCH TANK (RAPID COOLING)
6
21
22
ASH
9
MOLTEN ZINC
N2
19
OXIDATION OF Zn→ZnO
17
18
AIR
ZnO
2

QUENCHING OF ZNO-CHAR GASIFICATION

The invention relates to the gasification of source carbonaceous materials such as coal, char, coke, and the like.

BACKGROUND

In the gasification of solid carbonaceous source materials such as coal, char, coke, and the like, a metal oxide such as zinc oxide has been employed to provide at least part of the oxygen required. Such techniques are disclosed in U.S. Pat. Nos. 2,592,377 and 2,602,809.

In these processes, a finely divided solid particle form carbonaceous material is admixed with zinc oxide as the oxygen carrier or oxygen donor according to the basic reaction:

$$C+ZnO \rightarrow Zn+CO.$$

Formation of Zn vapor occurs in the gasification of the carbonaceous material such as char when using ZnO as the oxygen carrier or oxygen donor. It is necessary to cool the reaction products, which are gaseous, subsequent to the gasification. This leads to separation of Zn as a molten metal, and the gaseous CO, carbon monoxide, as the desired product.

Unfortunately, during cooling, formation of some zinc oxide also has been a partial result. Apparently, some reversion to the oxide of zinc occurs with consequent loss of a portion of the desired carbon monoxide. It is believed that zinc oxide forms due to the reversible reaction between zinc and traces of carbon dioxide, also present in the reaction product mixture in small concentrations:

$$Zn(g)+CO_2(g) \rightarrow ZnO(s)+CO(g)$$

The so-formed zinc oxide is an undesirable product since the zinc oxide tends to form a coating around droplets of molten zinc, depositing as a "blue powder" in zinc collection chambers, leading to line plugging, and preventing subsequent reoxidation of the metallic zinc inside the droplets for reuse. Excessive amounts of solid zinc oxide mixed with molten zinc create serious problems of material transport and handling of the molten zinc. U.S. Pat. No. 2,342,368 teaches a process for reduction of zinc oxide by carbonaceous materials, teaching one effort to reduce or prevent formation of blue powder, but recycles carbon monoxide to the feed and to the zinc oxide/char reactor. Blue powder has been a perennial problem in zinc handling for a long time. For example, the *Encyclopedia of Chemical Technology* (1970) in Vol. 22, page 579, in describing zinc metallurgy suggests chilling zinc vapor to avoid formation of blue powder, though there is no mention of a char gasification reaction.

BRIEF SUMMARY OF THE INVENTION

We have solved the problem of zinc oxide blue powder formation in zinc char gasification by rapid cooling (quenching) of the reaction products using cooled internally produced recycle carbon monoxide at low temperature. Since both of the streams, the product mixture and the recycle carbon monoxide, are gaseous, effective mixing of the two streams is quite feasible.

Rapid cooling in the reducing environment of the recycle carbon monoxide kinetically limits the formation of zinc oxide and avoids the formation of the objectionable blue powder.

BRIEF DESCRIPTION OF THE DRAWING

Makeup zinc oxide 1, usually with recycle (reformed) zinc oxide 2, is fed 3 with char 4 (or other carbonaceous material) to reactor 5. The admixture of particulate zinc oxide and char react to produce a gaseous stream 21 of primarily vaporous zinc, carbon monoxide, and some carbon dioxide. Gaseous stream 21 preferably via an ash trap 22 for separation of unvaporized ash, is taken 6, to quench zone 7 for rapid admixture with cooled carbon monoxide 16 in accordance with our invention. The rapid cooling in quench zone 7 under reductive conditions produces an off-gas stream 8 primarily of carbon monoxide with some traces of carbon dioxide, and a liquid stream 9 of molten zinc. The off-gas stream 8 is utilized in part as entraining gas 10 to zinc oxide/char reactor 5; primarily for product carbon monoxide 11; and in part to obtain hot off-gas stream 12 for cooling 13, such as by cooling water 14, 15 in heat exchanger 13, to produce cooled recycle carbon monoxide 16.

The entraining or sweep gas 10 is preferably downflow in reactor 5 since its primary purpose is to move product vapors 6 out of the reaction zone 5. The molten zinc 9 is reoxidized in oxidation contactor 17 by contact with air 18, producing a stream of particulate recycle zinc oxide 2, and a stream of nitrogen (and trace rare gases) off-gas 19 which can be otherwise utilized, such as in the production of ammonia for fertilizer, ammonia for single-cell protein plant, urea by reaction of ammonia with carbon dioxide, and the like. Heat is generated during zinc reoxidation 17; this heat can be exchanged by indirect heat exchange to heat gas stream 10 which thus helps bring the reactant in reactor 5 to reaction temperature. The amount of heat generated from this step is about 1.5 times greater than that required to generate carbon monoxide in reactor 5, e.g.

$$Zn+\tfrac{1}{2}O_2 \rightarrow ZnO+83 \text{ Kcal/mol}$$

$$ZnO+C \rightleftharpoons CO+Zn-56.4 \text{ Kcal/mol.}$$

Not shown, but an aspect, is the separation of traces of carbon dioxide from off-gas 8 and use, possibly augmented with oxidized CO, in reaction with ammonia to urea.

DETAILED DESCRIPTION OF THE INVENTION

In accordance with our invention, we have developed a process for the gasification of solid carbon containing materials by contact with zinc oxide to produce a gaseous off-gas stream of carbon oxides and zinc, utilizing rapid quench of the off-gases by cooled recycle carbon monoxide.

A feed comprising finely divided particulate carbon or carbon containing material is admixed with finely divided particles of zinc oxide.

The solid carbon or carbonaceous sources used in the process are those carbonaceous materials which are solid at temperatures of about 20° C. Examples of nonlimiting carbon sources are coal, coke, char, tar sand, peat, oil shale, lignite, rubber scrap, and the like. Particularly well suited are those solid carbon containing sources that are solid at temperatures even up to such as 2500° F. (1373° C.).

The process of our invention is effective to gasify and convert to valuable carbon monoxide even those solid carbon sources or solid residues from other gasifications or liquefaction processes such as those resulting from treating coal, oil shale, and residual oils. Solid char residues are produced, for example, by coal pyrolysis processes of various types.

The size of the carbon containing particles employed can vary over a wide range, smaller particles being preferred, preferably no more than about 0.4 mm in diameter on the average, with a preferred range of about 0.04 to 0.4 mm. Substantially all of the particles are such size as to pass through a standard U.S. 20 sieve.

The gasification reaction can be carried out using suitable techniques known in the art for this aspect of the process. Basically, the gasification comprises contacting the carbon particles with the zinc oxide at temperatures effective for oxidizing the carbon primarily to carbon monoxide and usually with some traces of carbon dioxide. These gasification reaction temperatures generally will be in the range of about 1700° F. to 2800° F. (928° C. to 1540° C.), presently preferably about 1800° F. to about 2200° F. (982° C. to 1204° C.).

The zinc oxide/char reactions involved are considered to be solid/solid reactions so that the pressures employed are not considered critical. Satisfactory operating pressures employed can be in the range of about atmospheric to upwardly of such as about 650 psig. Conveniently it is presently preferred for the pressure to be slightly above atmospheric pressure, such as about 0.1 to about 50 psig (102–446 kPa).

Although various means of contacting such as fixed beds can be employed, the most convenient and presently preferred method is to mix particles of carbon source material and zinc oxide together in an entrained bed. Recycled carbon monoxide can serve as a transporting gas, both to transport the reactants to the reaction zone and to move the reaction products to zone 7.

From the char reaction 5, the off-gases, comprising zinc, carbon monoxide, and some traces, 0.1 to 5 mole percent, of carbon dioxide, are quickly quenched 7 in accordance with the process of our invention by rapid cooling with recycle carbon monoxide. The recycle carbon monoxide should be at a temperature in the range of about 0° F. to 140° F. (−18° C. to 60° C.), more preferably about 20° F. to 80° F. (−7° C. to 27° C.), and conveniently ambient temperature. Quenching can be at any convenient pressure, such as about 1 to 1500 psi.

The ratio of cooled recycle carbon monoxide relative to the amount of zinc present in the off-gas stream 6 from the char reactor is a convenient measure, and should be in the range of about 5 to 50, preferably about 15 to 25, lb. moles of cooled carbon monoxide per pound mole of zinc. The resultant molten zinc should be at a temperature in the range of about 750° F. to 1110° F. (400° C. to 600° C.). The resulting hot off gas 8 will be at a temperature in the range of about 400° F. to 800° F. (200° C. to 425° C.).

The hot off-gas 8 carbon monoxide from the quench zone 7 in excess is taken as product 11 from the char zinc oxide process. The molten zinc 9, condensed by contact of the reaction off-gases with the cooled carbon monoxide, then is reoxidized 17 by contact with air 18.

Conversion of the molten zinc 9 to the zinc oxide particles 2 is obtained by oxidation of the molten zinc in a reactor 17 employing a ratio of air to zinc in the range of about 1 to 100, preferably 1 to 5, lb moles of air per pound mole of zinc. The type of reactor employed preferably and conveniently is an updraft kiln where air reacts with vapor zinc which is in equilibrium with a pool of liquid zinc at the bottom of the kiln. This type of reaction/reactor produces a finely divided particle form zinc oxide 2 suitable for further contacting 5 of additional char.

It presently is estimated that for a cooled off-gas carbon monoxide for use as quench gas in the temperature range of about 100° F. to 140° F., that about 7 to 42 pound moles of cooling water at from 40° F. to 90° F. is required to cool a pound mole of carbon monoxide.

CALCULATED EXAMPLE

The following idealized material balance is provided in order to assist in understanding the extent and scope of our invention.

| | Material Balance, pounds Basis: 100 lb of Zno | | | | | | | | | | |
|---|---|---|---|---|---|---|---|---|---|---|---|
| | Zinc Oxide Recycle | Char Feed | Gas Stream | Off Gas | Molten Zinc | Entraining Gas | Product Gas | Cooling Water | Quench Gas | Combustion Air | Flue Gas |
| Reference Stream Numbers (FIG. 1) | 2 | 4 | 6 | 8 | 9 | 10 | 11 | 14 | 16 | 18 | 19 |
| Carbon (C) | | 14.1 | | | | | | | | | |
| Hydrogen (H) | | 0.1 | | | | | | | | | |
| Nitrogen (N) | | 0.1 | | | | | | | | | |
| Sulfur (S) | | 0.2 | | | | | | | | | |
| Ash | | 5.5 | | | | | | | | | |
| $H_2O$ | | | 2.2 | 21.9 | | 1.3 | 0.9 | 600 | 19.7 | | |
| CO | | | 80.8 | 803.5 | | 47.8 | 33.0 | | 722.6 | | |
| $CO_2$ | | | *trace | trace | | trace | trace | | trace | | |
| NO | | | 0.5 | 4.9 | | 0.3 | 0.2 | | 4.4 | | |
| $SO_2$ | | | 1.0 | 9.7 | | 0.6 | 0.4 | | 8.8 | | |
| Zinc (Zn) | | | 80.8 | | 80.0 | | | | | | |
| ZnO | 100.0 | | | | | | | | | | |
| Oxygen ($O_2$) | | | | | | | | | | 20.0 | |
| Nitrogen ($N_2$) | | | | | | | | | | 66.2 | 66.2 |
| Totals | 100.0 | 20.0 | 164.5 | 840.0 | 80.0 | 50.0 | 34.5 | 600 | 755.5 | 86.2 | 66.2 |

*less than 1%.

The disclosure, including data, has illustrated the value and effectiveness of our invention. The material balance, knowledge and background of the field of the invention, the knowledge and background of general principles of metallurgy, chemistry, and other applicable sciences, all have formed the bases to which the broad descriptions of the inventions, including the ranges of conditions have been developed, and thereby formed the bases for our claims here appended.

We claim:

1. A process for the gasification of solid carbon containing materials which comprises:

(a) heating in an entrainment bed reaction means under endothermic reaction conditions finely divided carbon containing particles with finely divided zinc oxide employing as heat source hot entraining sweep gas, thereby producing a hot gaseous stream comprising zinc, carbon monoxide, and traces of carbon dioxide, (b) quenching said hot gaseous stream with cool recycle carbon monoxide, thereby condensing said zinc as molten zinc metal while avoiding substantially the formation of blue powder, and producing an off-gas stream of hot carbon monoxide, (c) reoxidizing said molten zinc by contact with air in oxidation contactor means, thereby producing finely divided zinc oxide for recycle to said step (a), and nitrogen as a second off-gas stream, (d) further heating a portion of said off-gas stream of hot carbon monoxide from said step (b) by indirect heat exchange with said oxidation contactor means step (c), thereby producing said hot entraining sweep gas for recycle to said step (a) to provide heat thereto, (e) cooling by indirect heat exchange means a further portion of said hot off-gas carbon monoxide stream from said step (b) to provide said cool carbon monoxide quench gas, and (f) withdrawing a further portion of carbon monoxide gas as product.

2. The process according to claim 1 wherein said carbon is provided by coal, coke, char, tar sand, peat, oil shale, lignite, or rubber scrap.

3. The process according to claim 2 wherein the finely divided particles of carbon feed are no more than about 0.4 mm in diameter on the average.

4. The process according to claim 3 wherein said contacting of said carbon feed particles with said zinc oxide particles is conducted at a temperature in the range of about 1800° F. to 2200° F., a pressure of about 0.5 to 1.5 atmospheres.

5. The process according to claim 4 wherein said quenching recycle carbon monoxide is at a temperature in the range of about 0° F. to 140° F., employing a pressure in the range of about 1 to 1500 psi.

6. The process according to claim 5 wherein said entraining sweep gas passes downflow through said reaction means.

* * * * *